United States Patent [19]

Kiga

[11] Patent Number: 4,702,180

[45] Date of Patent: Oct. 27, 1987

[54] PULVERIZED COAL BURNER DEVICE

[75] Inventor: Takashi Kiga, Yokohama, Japan

[73] Assignee: Ishikawajima-Harima Jukogyo Kabushiki Kaisha, Japan

[21] Appl. No.: 29,722

[22] Filed: Mar. 24, 1987

[30] Foreign Application Priority Data

Apr. 4, 1986 [JP] Japan ..... 61-77741

[51] Int. Cl.[4] ..... F23D 1/00

[52] U.S. Cl. ..... 110/263; 110/106; 110/232; 110/264; 110/347

[58] Field of Search ..... 110/106, 263, 264, 265, 110/347, 232; 431/12, 284, 285

[56] References Cited

U.S. PATENT DOCUMENTS

| | | | |
|---|---|---|---|
| 4,249,470 | 2/1981 | Vatsky | 110/264 X |
| 4,261,582 | 11/1986 | Cooper | 110/264 |
| 4,333,405 | 6/1982 | Michelfelder et al. | 110/264 |
| 4,426,938 | 1/1984 | Leikert et al. | 110/347 |
| 4,426,939 | 1/1984 | Winship | 110/347 |
| 4,448,135 | 5/1984 | Dougan et al. | 110/263 |
| 4,497,263 | 2/1985 | Vatsky et al. | 110/347 |
| 4,611,543 | 9/1986 | Colette | 110/263 |
| 4,627,366 | 12/1986 | La Rue et al. | 110/263 |
| 4,669,398 | 6/1987 | Takahashi et al. | 110/347 |

*Primary Examiner*—Edward G. Favors

[57] ABSTRACT

A pulverized coal burner device capable of ensuring stabilized combustion of pulverized coal even when mill load is low.

4 Claims, 2 Drawing Figures

PULVERIZED COAL BURNER DEVICE

BACKGROUND OF THE INVENTION

The present invention relates to a pulverized coal burner device capable of ensuring stable combustion even when mill load is low.

Coal pulverized by a mill is entrained in a stream of primary air so as to be burned in a pulverized coal burner device. The primary air carrying the pulverized coal must flow at a flow rate beyond some lower limit in order that the pulverized coal can be entrained in the primary air even when the mill load is lowered and supply of the pulverized coal from the mill is decreased. Therefore, in response to reduction of the mill load, a ratio A/C between the quantity (A) of the primary air and the quantity (C) of the pulverized coal becomes high. Meanwhile, it is preferable that the ratio A/C is less than 2.5 or 3.0 or so in order to ensure stabilized combustion in the pulverized coal burner. Turndown (limit of combustion with a lower load) of the pulverized coal burner is on the order of 40% of the mill load.

Therefore, for low mill load, there has been devised and demonstrated a device as shown in FIG. 1 which utilizes a system as used in coal-burning boilers. More specifically, pulverized coal entrained in a stream of primary air flowing from a mill a is separated from the primary air in a cyclone b so that the ratio A/C becomes a predetermined value; the separated pulverized coal is injected through a burner c into a furnace d and is burned while the primary air substantailly free from the pulverized coal is forced into the furnace d through a port e opened on the upper portion of the furnace d, whereby a slight quantity of pulverized coal in the primary air is burned.

With the above-described device and in the case of low mill load, the upper portion of the furnace d is so low in temperature that the pulverized coal injected through the port e into the furnace d will not burn and consequently combustion efficiency is decreased. Furthermore, there is a serious problem that the unburned pulverized coal may trigger an explosion of coal dusts downstream of the furnace. Moreover, temperature of the primary air carrying the pulverized coal is too low to be used as secondary air.

In view of the above, a primary object of the present invention is to provide a pulverized coal burner device capable of ensuring stabilized combustion even in the case of low mill load.

The above and other objects, effects, features and advantages of the present invention will become more apparent from the following description of a preferred embodiment thereof taken in conjunction with the accompanying drawings.

DETAILED DESCRIPTION OF THE PREFERRED EMBODIMENT

Figure 1:
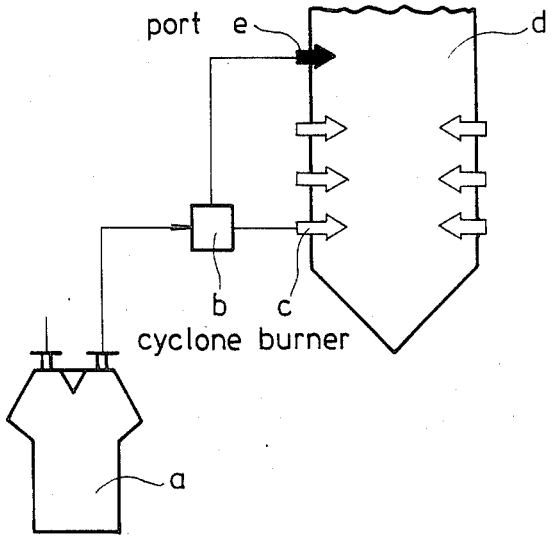
Fig. 1 PRIOR ART
FIG. 1 is a view used to explain one example of conventional pulverized coal burner devices.
Figure 2:
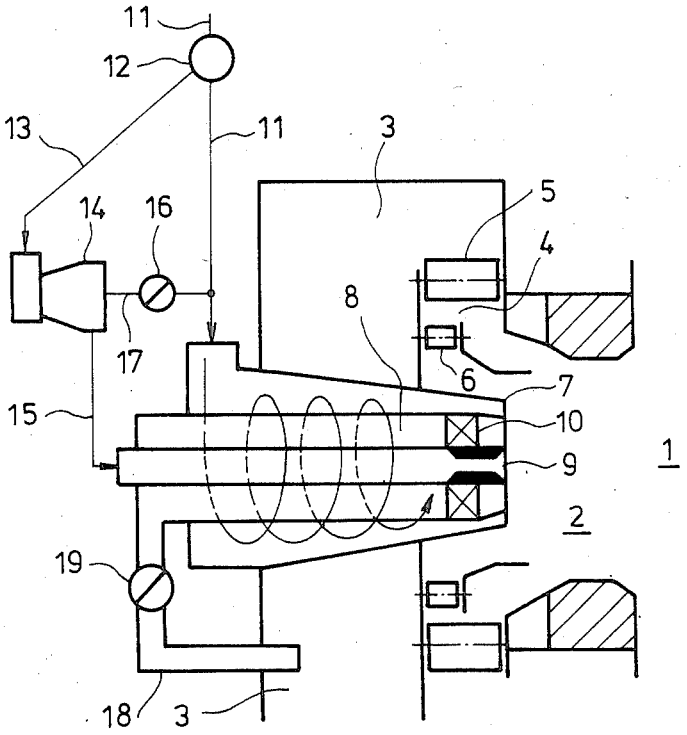
FIG. 2 is a view used to explain a preferred embodiment of pulverized coal burner device in accordance with the present invention.

FIG. 2 illustrates a preferred embodiment of a pulverized coal burner device in accordance with the present invention in which reference numeral 1 designates a furnace; 2, a port on a side wall of the furnace 1; 3, a wind box in front of the port 2; 4, a secondary air passage through which the secondary air is forced from the wind box 3 into the furnace 1; 5, an air resister in the secondary air passage; 6, an inner vane in the secondary air passage 4; 7, a pulverized coal nozzle used when the load is high; 8, a tertiary air passage; 9, a pulverized coal nozzle used when the load is low; and 10, a swirler in the tertiary air passage 8.

A pipe line 11 for transporting the pulverized coal from a mill is communicated with the outer periphery of the rear end of the high-load pulverized coal nozzle 7. A dividing damper 12 is in the pipe line 11 and is adapted to be actuated in response to the density of pulverized coal from the mill. A pipe line 13 branched from the dividing damper 12 is communicated with a horizontal cyclone 14 which in turn is communicated with a pipe line 15 for supplying the separated pulverized coal to the low-load pulverized coal nozzle 9 as well as with a pipe line 17 for introducing the air substantially free from the pulverized coal into the pipe line 11 through a cyclone outlet damper 16. The tertiary air passage 8 is communicated with a pipe line 18 for supplying the tertiary air damper 19 into tertiary air passage 8.

When the mill load is high, the dividing damper 12 is so activated that the pipe line 13 is cut off from transportion of the pulverized coal while intercommunication between the horizontal cyclone 14 and the pipe line 11 is interrupted by changeover of the damper 16. Furthermore, the tertiary air damper 19 is so adjusted that a predetermined quantity of the tertiary air is supplied from the wind box 3 to the tertiary air passage 8. In addition, the degree of opening of each of the air resister 5 and inner vane 6 is set to a predetermined value. Thus, the operation is started.

The pulverized coal entrained in the stream of the primary air flowing through the pipe line 11 from the mill is introduced together with the primary air into the high-load pulverized coal nozzle 7 and is injected into the furnace 1 through the nozzle hole at the leading end of the nozzle 7. The injected pulverized coal is burned with the secondary air which flows from the wind box 3 through the secondary air passage 4, is swirled by the air resister 5 and inner vane 6 and is blown into the furnace 1. The tertiary air introduced from the wind box 3 into the tertiary air passage 8 through the pipe line 18 is swirled by the swirler 10 and is injected from the leading end of the tertiary air passage 8 into the furnace 1, whereby reverse flow of the pulverized coal injected through the high-load pulverized coal nozzle 7 can be prevented.

Alternatively, in such a case of high mill load, the damper 12 may be so switched as to divide the stream of the pulverized-coal ridden primary air into the pipe lines 11 and 13 as needs demand (as is the case where the pulverized coal leaks from the damper and accumulates in the low-load pulverized coal nozzle 9). The flow rates in the pipe lines 11 and 13 are adjusted by the dividing damper 12. The density of the pulverized coal fed to the damper 9 is adjusted by the cyclone outlet damper 16.

In case of low mill load, the dividing damper 12 is so switched that the all of the stream of the pulverized-coal ridden primary air is led to the pipe line 13. The cyclone outlet damper 16 and tertiary air damper 19 are respectively controlled to predetermined degrees of opening while the air resister 5 and inner vane 6 are closed. Under these conditions, the operation is carried on.

The pulverized coal entrained in the steam of the primary air flowing through the pipe lines 11 and 13 is introduced into the horizontal cyclone 14 together with the primary air. The pulverized coal separated in the horizontal cyclone 14 and having a high density is supplied together with a slight portion of the primary air through the pipe line 15 into the low-load pulverized coal nozzle 9, is injected through the leading end of the nozzle 9 into the furnace 1 and is burned with the tertiary air blown through the tertiary air passage 8 into the furnace 1 as the combustion air.

The air containing a slight quantity of pulverized coal which is not separated in the horizontal cyclone 14 and has a low density has too low temperature so that it cannot be utilized as secondary air. The air flows through the pipe line 17 and the high-load pulverized coal nozzle 7 and is injected into the furnace 1 so as to swirl outwardly of the tertiary air, whereby the slight quantity of pulverized coal is burned.

The ratio A/C between the quantity of the primary air and the quantity of pulverized coal in the low-load pulverized coal nozzle 9 is adjusted by the cyclone outlet damper 16.

In case of low mill load, the pulverized coal is burned in the manner described above so that the turndown comes to be on the order of 10% of the mill load.

It is to be understood that the present invention is not limited to the preferred embodiment just described above and that variations, alternations and/or modifications may be resorted to without departing from the spirit of the present invention.

The pulverized coal burner device in accordance with the present invention ensures stable combustion even when the mill load is low and can prevent an explosion of coal dusts so that safety of operation can be enhanced.

What is claimed is:

1. A pulverized coal burner device comprising a pulverized coal burner extending through a wall of a furnace and having a low-load pulverized coal nozzle, a tertiary air passage which surrounds said low-load pulverized coal nozzle and a high-load pulverized coal nozzle which surrounds said tertiary air passage, a line for supplying the pulverized coal to said high-load pulverized coal nozzle when a density of pulverized coal entrained in a primary air from a mill is high, separation means connected to said line for separating the pulverized coal and the primary air supplied through said line when the density of the pulverized coal in the primary air is low, thereby increasing the density of the pulverized coal, a line for supplying the air thus having the pulverized coal with the increased density to said low-load pulverized coal nozzle, a line for supplying tertiary air to said tertiary air passage, and a line for supplying to said high load pulverized coal nozzle the separated air containing a slight quantity of pulverized coal from said separation means.

2. The device according to claim 1 wherein said separation means comprises a horizontal cyclone.

3. The device according to claim 1 wherein switching adjustment of supply of the pulverized coal to a line leading to said separation means and to the line leading to said high-load pulverized coal nozzle is accomplished by a dividing damper.

4. The device according to claim 1 wherein density of the pulverized coal in the air supplied from said separation means to said low-load pulverized coal nozzle is adjusted by controlling a quantity of air which is supplied from said separation means to said high-load pulverized coal nozzle and contains slight quantity of pulverized coal.

* * * * *